US007918967B2

(12) United States Patent
Jiang et al.

(10) Patent No.: US 7,918,967 B2
(45) Date of Patent: Apr. 5, 2011

(54) APPARATUS FOR DECREASING SCALING IN DIGESTER SYSTEMS

(75) Inventors: Jianer Jiang, Mason, OH (US); Gerald Wayne Hill, Springboro, OH (US)

(73) Assignee: International Paper Company, Memphis, TN (US)

( * ) Notice: Subject to any disclaimer, the term of this patent is extended or adjusted under 35 U.S.C. 154(b) by 416 days.

(21) Appl. No.: 11/809,692

(22) Filed: Jun. 1, 2007

(65) Prior Publication Data

US 2007/0227681 A1 Oct. 4, 2007

Related U.S. Application Data

(62) Division of application No. 10/877,529, filed on Jun. 26, 2004, now Pat. No. 7,241,363.

(51) Int. Cl.
*D21C 7/14* (2006.01)
*D21C 7/00* (2006.01)

(52) U.S. Cl. ..... 162/248; 162/29; 162/41; 162/237

(58) Field of Classification Search ..... 162/29, 162/41, 237, 248

See application file for complete search history.

(56) References Cited

U.S. PATENT DOCUMENTS

| | | | |
|---|---|---|---|
| 4,071,399 | A | 1/1978 | Prough |
| 4,221,632 | A | 9/1980 | Loe, Jr. |
| 4,547,264 | A | 10/1985 | Sherman et al. |
| 4,578,149 | A | 3/1986 | Fagerlund |
| 4,755,258 | A | 7/1988 | Ryham |
| 5,080,755 | A | 1/1992 | Backlund |
| 5,192,396 | A | 3/1993 | Backlund |
| 5,254,286 | A | 10/1993 | Gill et al. |
| 5,441,602 | A | 8/1995 | Harris et al. |
| 5,489,363 | A | 2/1996 | Marcoccia et al. |

(Continued)

FOREIGN PATENT DOCUMENTS

EP 0313730 A1 3/1989

(Continued)

OTHER PUBLICATIONS

N. Hartler & J Libert, "The behavior of certain inorganic ions in the wood/white/liquor system, "Svensk Papperstid., 76(12): 454-457, 1973.

(Continued)

*Primary Examiner* — Eric Hug
*Assistant Examiner* — Anthony J Calandra
(74) *Attorney, Agent, or Firm* — Matthew M. Eslami

(57) ABSTRACT

The invention relates to an apparatus for continuous digestion of wood chip comprising an upright generally cylindrical vessel having a top end and a bottom end. The top end of the cylindrical vessel is adapted to receive wood chips mixed with a cooking liquor to be treated therein. A first conduit is integrally attached at a first location positioned between the top and bottom ends of the vessel for selectively extracting a first quantity of cooking liquor from the vessel. The first location is positioned upstream of a second location within the vessel where the cooking liquor being at substantially full cooking temperature. A second conduit is integrally attached at a third location positioned downstream from the first and second locations of the vessel. The second conduit is in fluid communication with a fourth location positioned at, about below or upstream from the first location for selectively extracting a second quantity of cooking liquor from the vessel at the third location and transporting at least a portion of the extracted second quantity of cooking liquor to the fourth location.

18 Claims, 6 Drawing Sheets

EXHIBIT 1

Single-vessel Hydraulic Digester

U.S. PATENT DOCUMENTS

| | | | |
|---|---|---|---|
| 5,536,366 | A | 7/1996 | Marcoccia et al. |
| 5,547,012 | A | 8/1996 | Marcoccia et al. |
| 5,575,890 | A | 11/1996 | Prough et al. |
| 5,620,562 | A | 4/1997 | Marcoccia et al. |
| 5,650,045 | A | 7/1997 | Salminen |
| 5,662,775 | A | 9/1997 | Marcoccia et al. |
| 5,674,359 | A | 10/1997 | Chasse et al. |
| 5,716,497 | A | 2/1998 | Richter et al. |
| 5,824,187 | A | 10/1998 | Richter et al. |
| 5,824,188 | A | 10/1998 | Prough et al. |
| 5,849,150 | A | 12/1998 | Marcoccia et al. |
| 5,849,151 | A | 12/1998 | Marcoccia et al. |
| 6,086,712 | A | 7/2000 | Marcoccia et al. |
| 6,090,240 | A | 7/2000 | Eneberg et al. |
| 6,103,058 | A | 8/2000 | Engstrom |
| 6,123,807 | A | 9/2000 | Engstrom et al. |
| 6,132,556 | A | 10/2000 | Stromberg et al. |
| 6,146,495 | A | 11/2000 | Duggirala et al. |
| 6,159,336 | A | 12/2000 | Engstrom et al. |
| 6,159,337 | A | 12/2000 | Marcoccia et al. |
| 6,203,662 | B1 | 3/2001 | Snekkenes et al. |
| 6,232,419 | B1 | 5/2001 | Duggirala et al. |
| 6,235,151 | B1 | 5/2001 | Fagerlind et al. |
| 6,235,152 | B1 | 5/2001 | Duggirala et al. |
| 6,277,240 | B1 | 8/2001 | Marcoccia et al. |
| 6,280,568 | B1 | 8/2001 | Marcoccia et al. |
| 6,346,167 | B2 | 2/2002 | Marcoccia et al. |
| 6,939,439 | B1 | 9/2005 | Paakki et al. |
| 2001/0035271 | A1 | 11/2001 | Duggirala et al. |
| 2002/0129911 | A1* | 9/2002 | Marcoccia et al. ..... 162/41 |
| 2003/0010458 | A1 | 1/2003 | Thompson et al. |
| 2003/0075290 | A1 | 4/2003 | Thompson et al. |

FOREIGN PATENT DOCUMENTS

| | | |
|---|---|---|
| EP | 0375800 | 7/1990 |
| WO | WO 00/11263 | 3/2000 |
| WO | WO 01/25531 | 4/2001 |

OTHER PUBLICATIONS

L D Markham & J.R. Bryce, "Formation of calcium carbonate scale in a continuous digester," Tappi J. 63(4); 125-127, 1980.

W. W. Al-Dajani & G. Gellerstedt, "Cooking parameters controlling the light absorption coeficient of alkaline pulps," Proceedings of the 11th International Symposium, France.

* cited by examiner

APPARATUS FOR DECREASING SCALING IN DIGESTER SYSTEMS

RELATED APPLICATION

This application is a divisional of application Ser. No. 10/877,529 now U.S. Pat. No. 7,241,363 filed on Jun. 26, 2004.

FIELD OF INVENTION

The present invention relates to digestion of wood chips in a digester employing alkaline liquor for the production of paper pulp.

BACKGROUND OF INVENTION

In the papermaking industry, wood logs are converted into chips, which are subsequently treated in a digester system to separate the cellulose fibers and to remove desired amounts of lignin, etc., which binds the fibers together in the natural state of wood, for the production of paper pulp.

Digestion of wood chips employing an alkaline liquor is a common practice in the industry. In this process, commonly wood chips and an alkaline digesting liquor, sometimes premixed, are introduced to a top inlet zone of a continuous digestion vessel (a digester). In the digestion process, the chips and liquor move generally, but not always, together downward through the digester, the digestion reaching generally optimal completion when the mass reaches the bottom portion of the digester. A typical digester is divided into various zones such as the inlet zone, an upper digestion zone within which, among other things, the chip/liquor mass is heated toward a full cook temperature, a full cook zone within which the mass is subjected to a full cook temperature for a selected period of time, an extraction zone within which digestion spent liquor (black liquor at this point) is withdrawn from the digester, a wash zone in which the mass is washed with process liquids to wash the dissolved solids in the black liquor from the mass, and a withdrawal zone in which the mass of (partially) washed pulp is withdrawn from the digester and passed to further treatment apparatus, such as pulp washers.

Scaling occurs on surfaces of the equipment in an alkaline pulping system and results in loss in productivity and higher operating costs. Severe scaling in a continuous digester system often leads to loss of production of up to several days a year for scale removal by acid cleaning or high-pressure hydro blasting. Currently there are no known cost-effective process modifications to prevent scaling from forming, and many mills rely on the use of a class of expensive chemicals, known as "antiscalants" in the art, as pulping additives to suppress scaling. Even with the antiscalants, costly periodic cleaning of heaters or other digester equipment is often required.

Calcium carbonate has been shown to be a key component of scale formed on surfaces of alkaline pulping equipment such as digester cooking heaters and digester screens. In addition, wood generally is the single largest source of calcium present in cooking liquor. The solubility of calcium salts in alkaline pulping liquor has been found first increases and then decreases with increasing cooking temperature and/or cooking time. When the amount of calcium in the cooking liquor exceeds its solubility, calcium precipitates as calcium carbonate and, along with lignin and other deposits, forms scale on the surface of heater, screens and digester shell wall. Thus, under typical alkaline pulping conditions, the amount of dissolved calcium in the cooking liquor increases as cooking proceeds, goes through a maximum near when the maximum cooking temperature is reached, and decreases rapidly afterward as a result of calcium carbonate precipitation onto equipment surfaces (scaling) and surfaces of chips/fibers.

Scaling tendency of calcium in cooking liquor has been shown to decrease dramatically after the liquor has been heated at or near typical full cooking temperatures. This action is, at times, referred to in the art as calcium deactivation by heat treatment, and has been practiced in some digesters. An exemplary application of this calcium deactivation, as described in European Patent Application EP 0313730 A1, comprises of heating cooking liquor high in calcium at or near full cooking temperature, holding it at this temperature in a vessel for a period of time, typically longer than ten minutes, and returning the heat treated liquor, with "deactivated" calcium, to the digester system. Because scale forms on the surfaces of this "sacrificial" vessel, generally at least two vessels are needed in order to maintain continuous operation of calcium deactivation, with at least one vessel being online and one vessel being cleaned of scales. This technology is probably effective, but requires addition capital and operating costs, and therefore is not widely practiced in the industry.

Cleaning accumulated scale from a digester requires taking the digester offline and removal of the scale, commonly by chemical dissolution of the scale and/or pressure cleaning with a liquid. This cleaning consumes several days of downtime of the digester in addition to the labor required to perform the cleaning, both of which are very costly. As a consequence of such cost, cleaning of digesters is commonly conducted no more frequently than annually. The gradual accumulation of scale within the digester over the period of a year results in ever increasing loss of efficiency as more and more scale develops. It is therefore most desirable that a method be provided for reducing or substantially eliminating the accumulation of scale within a digester.

SUMMARY OF PRESENT INVENTION

One aspect of the present invention relates to an apparatus for continuous digestion of wood chip comprising an upright generally cylindrical vessel having a top end and a bottom end. The top end of the cylindrical vessel is adapted to receive wood chips mixed with a cooking liquor to be treated therein. A first conduit is integrally attached at a first location positioned between the top and bottom ends of the vessel for selectively extracting a first quantity of cooking liquor from the vessel. The first location is positioned upstream of a second location within the vessel where the cooking liquor being at substantially full cooking temperature. A second conduit is integrally attached at a third location positioned downstream from the first and second locations of the vessel. The second conduit is in fluid communication with a fourth location positioned at, about below or upstream from the first location for selectively extracting a second quantity of cooking liquor from the vessel at the third location and transporting at least a portion of the extracted second quantity of cooking liquor to the fourth location.

Another aspect of this invention relates to an apparatus for continuous digestion of wood chip comprising a vessel having a top end and a bottom end. The top end of the vessel is adapted to receive wood chips to be treated therein. A first conduit is integrally attached at a first location positioned between the top and bottom ends of the digester for selectively extracting a first quantity of cooking liquor from the vessel. The first location is positioned upstream of a second location within the vessel where the cooking liquor being at substantially full cooking temperature. A second conduit is integrally attached at a third location positioned downstream from the first and second locations of the vessel. The second conduit is in fluid communication with a fourth location positioned at, about below or upstream from the first location for selectively extracting a second quantity of cooking liquor from the vessel at the third location and transporting at least a portion of the extracted second quantity of cooking liquor to the fourth location. A third conduit is integrally attached to a fifth location positioned outside of the vessel. The third conduit is in fluid communication with the fourth location positioned at, about below or upstream from the first location for selectively extracting a second quantity of cooking liquor from the vessel.

Yet another embodiment of this invention relates to an apparatus for continuous digestion of wood chip which comprising an upright generally first cylindrical vessel having a top end and a bottom end. The top end of the first cylindrical vessel is adapted to receive wood chips mixed with a cooking liquor to be treated therein. An upright generally second cylindrical vessel is configured to be in fluid communication with the first cylindrical vessel. The second vessel having a top end and a bottom end, the top end of the second cylindrical vessel is adapted to receive the treated wood chips from the first vessel. A first conduit is integrally attached at a first location positioned between the top and bottom ends of the second cylindrical vessel for selectively extracting a first quantity of cooking liquor from the second cylindrical vessel. The first location is positioned upstream of a second location within the second cylindrical vessel where the cooking liquor being at substantially full cooking temperature. A second conduit is integrally attached at a third location positioned downstream from the first and second locations of the second cylindrical vessel. The second conduit is in fluid communication with a fourth location positioned at, about below or upstream from the first location for selectively extracting a second quantity of cooking liquor from the second cylindrical vessel at the third location and transporting at least a portion of the extracted second quantity of cooking liquor to the fourth location.

One or more advantages flow from the present invention. One advantage is reduced calcium carbonate scaling. The apparatus and process modifications disclosed in the present invention can be tailored to a digester system such that net reduction in pulping energy requirement, in the form of medium or high pressure steam consumption, can be realized for more cost savings. Furthermore, when the content of dissolved solids in the process stream(s) added to the early stages of a cook that is lower than in the liquor removed from the cooking system, washing of the cooked chips is generally improved, and a smaller amount of weak black liquid can be used in pulp washing. As a result, a smaller amount of washing liquor used, a higher total solid is sent to evaporators and additional savings are realized from a lower steam demand in the weak black liquor evaporation. In addition, removal of calcium and other non-process elements, as well as certain extractives, from the early stages of a cook has been found to improve pulp brightness and bleachability. Thus the present invention also results in still more savings from a lower pulp bleaching cost as an additional benefit.

DETAILED DESCRIPTION OF INVENTION

Figure 1:
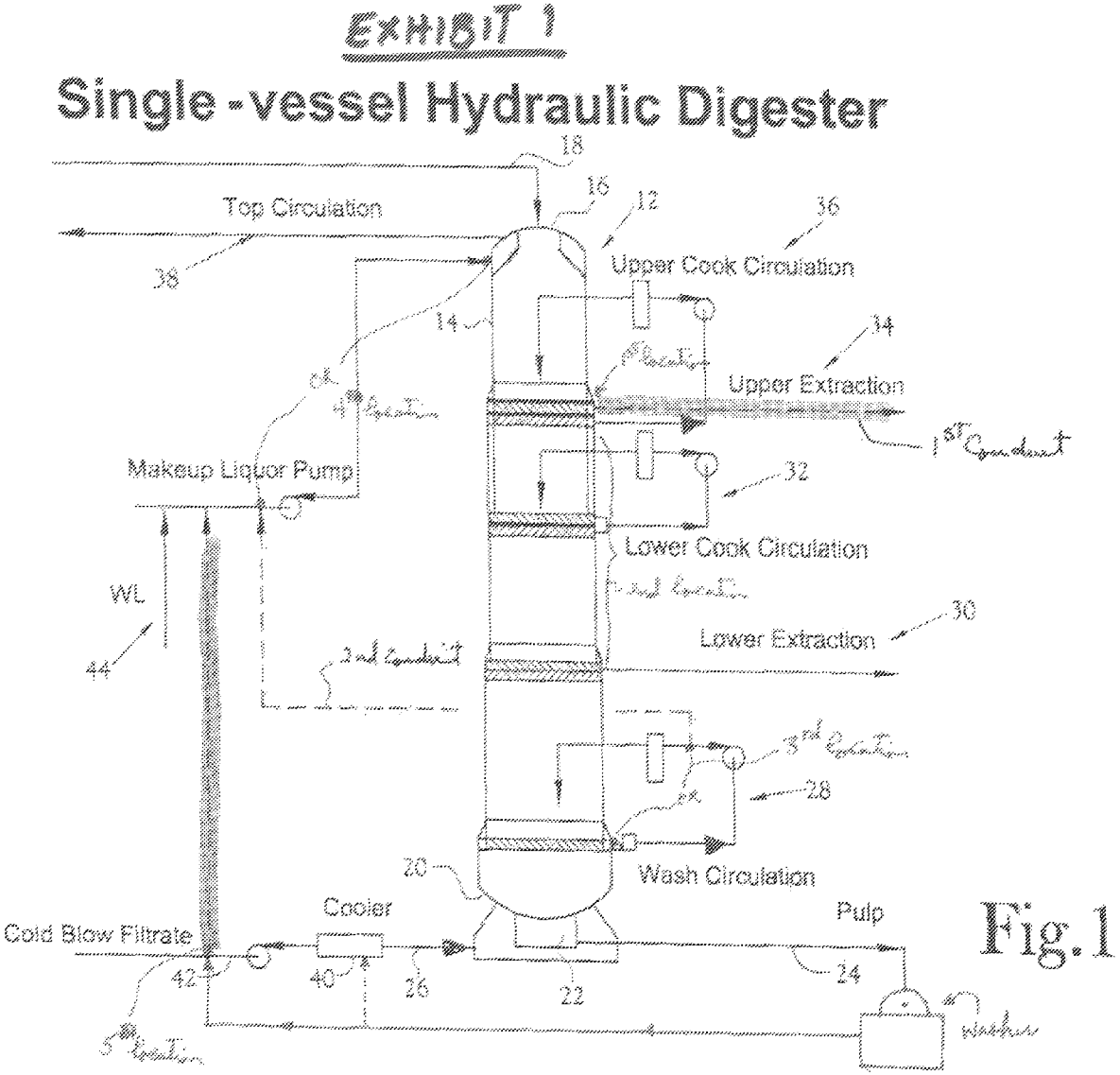
FIG. 1 is a schematic representation of a typical single-vessel digester system and depicting key features of the system piping associated with the method of the present invention.

With reference to FIG. 1, there is schematically depicted a typical single-vessel hydraulic continuous digester 12 suitable for use in carrying out the method of the present invention. The depicted digester 12 includes an upright generally cylindrical vessel 14 having a top end 16 where there is received a supply of wood chips and alkaline cooking liquor 18 and a bottom end 20 which includes a blow assembly 22 by means of which a stream 24 of cooked chips and spent cooking liquor (pulp) is removed from the vessel. In the depicted embodiment, intermediate the top and bottom ends of the vessel there are provided a wash circulation sub-system 28, a lower extraction location 30, a lower cook circulation sub-system 32, an upper extraction location 34, an upper cook circulation sub-system 36, and a top circulation subsystem 38.

At the bottom of the vessel, the removed pulp stream is sent to a first pulp washer (not shown) via 24, and the washing filtrate 42 from the first pulp washer is often cooled in cooler 40, "cold blow filtrate" 26 as commonly known in the art, and introduced to the bottom of the digester for cooling and washing the cooked chips above the blow assembly 22. This filtrate is available for recirculation to the vessel, either with or without cooling, and with or without further treatment before or after having been mixed with a stream of white liquor (WL) 44 and/or black liquor extracted from the upper and/or lower extraction locations on the digester, and reintroduced into the vessel, such as at the top end of the vessel. In FIG. 1, the key feature of the process piping involved in the method of the present invention is set forth as dashed lines.

Figure 2:
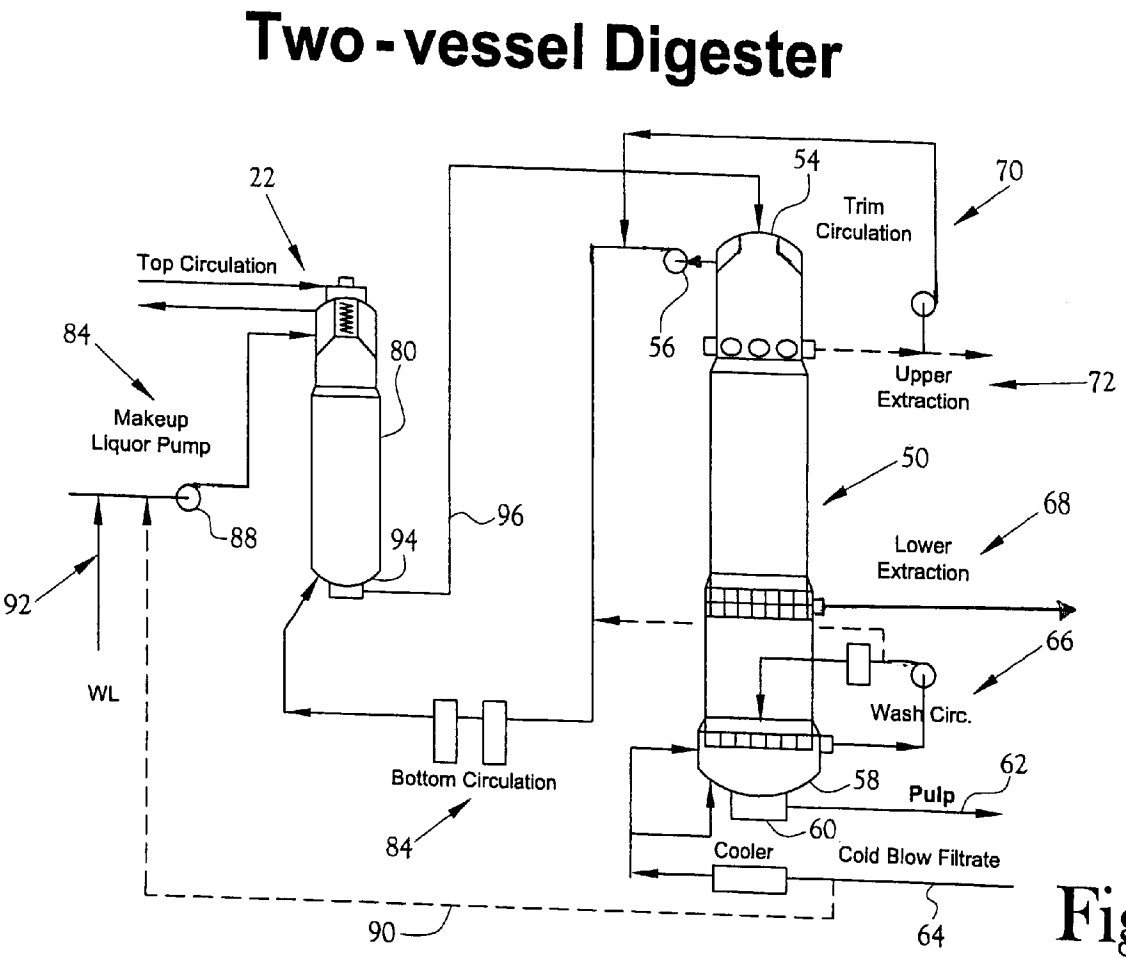
FIG. 2 is a schematic representation of a typical two-vessel digester system and depicting key features of the system piping associated with the method of the present invention.

With reference to FIG. 2, there is schematically depicted a typical two-vessel continuous digester 50 suitable for use in carrying out the method of the present invention. As depicted in FIG. 2, the digester has associated therewith a upright generally cylindrical first vessel and second vessel, where the first vessel 80 having a top circulation sub-system 82, a bottom circulation sub-system 84 and a liquor makeup sub-system 86 including a makeup-liquor pump 88. This first vessel serves as a source of pretreated wood chips mixed with cooking liquor that may originate from any one or more sources such as cold blow filtrate 90, and/or white liquor (WL) 92. The wood chips are pretreated in this first vessel and discharged from the bottom end 94 of the first vessel, thence conveyed as a supply stream 96 to the top end of the second vessel. As desired, liquor extracted from the lower extraction location 68 on the second vessel may be added to the supply stream to the second vessel. In FIG. 2, the key features of the process piping involved in the practice of the present invention is set forth as dashed lines.

The depicted digester 50 includes an upright generally cylindrical second vessel having a top end 54 where there is received a supply of wood chips and alkaline cooking liquor 56 and a bottom end 58 which includes a blow assembly 60 by means of which a stream 62 of cooked chips and spent cooking liquor (pulp) is removed from the vessel, such stream being sent to a pulp washer 9 not shown). The washing filtrate from the pulp washer 64, also known as cold blow filtrate in the art, may be cooled and sent to the bottom of the second vessel for cooling and washing the cooked chips above the blow assembly 60. This cold blow filtrate is also available for recirculation to the first vessel 80, either without further treatment or after having been mixed with a stream of white liquor 92 and conveyed into the first vessel. In the depicted embodiment of FIG. 2, intermediate the top and bottom ends of the vessel there are provided a wash circulation sub-system 66, a lower extraction location 68, and a trim circulation sub-system 70. An upper extraction location 72 is associated with the trim circulation sub-system.

EXAMPLE I

The preferred embodiment of the method of the present invention was employed with the digester depicted in FIG. 1. In this single-vessel continuous digester, cooking liquor rich in dissolved calcium of ~40-120 ppm is withdrawn from the first row of screens of the upper cook circulation screen set at a flow rate of 0.10-0.50 (GPM for each ton per day production rate, or GPM/TPD) factor. (For example, for a pulp production rate of 750 tons per day, 0.1-0.5 times 750, yields 75-350 gallons per minute (GPM). A mixture of cold blow filtrate and wash extraction streams, the sum of which is about the same as the upper extraction flow and the concentration of dissolved calcium is less than 40 ppm, is added to the top of the digester via the makeup liquor pump. In this example, up to about 45% of the total dissolved calcium may be removed from the digester system, significantly reducing the tendency of calcium scaling on digester screens and cooking heaters.

EXAMPLE II

In a further example of the preferred embodiment of the method of the present invention, employing a single vessel digester as depicted in FIG. 1, cooking liquor with~100 ppm dissolved calcium is withdrawn from the first row of screens of the upper cook circulation screen set at a flow rate of 0.35 (gallons per minute for each ton per day production rate, or GPM/TPD) factor, For example, for a pulp production rate of 750 tons per day, the extraction flow rate is 0.35 times 750, or~262 gallons per minute (GPM). A mixture of cold blow filtrate and wash extraction flows, the sum of which is about the same as the upper extraction flow and concentration of dissolved calcium is less that 40 ppm is added to the top of the digester via the makeup liquor pump. In this example, up to about 35% of the total dissolved calcium may be removed from the digester system, significantly reducing the tendency of calcium scaling on digester screens and cooking heaters.

EXAMPLE III

In a still further example employing the preferred embodiment of the method of the present invention, in a single vessel digester as depicted in FIG. 1, cooking liquor rich in dissolved calcium of ~100 ppm is withdrawn from the first row of screens of the upper cook circulation screen set at a flow rate of 0.35 gallons per minute for each ton per day production rate (GPM/TPD) factor. For example, for a pulp production rate of 750 tons per day, the flow rate is 0.35 times 750, or ~262 gallons per minute (GPM). A cooking liquor taken from the wash circulation, at about the same flow rate with concentration of dissolved calcium less than 40 PPM, is added to the suction side of the upper cook circulation pump to replace the extracted calcium-rich cooking liquor, thus keeping the hydraulic balance of the digester. The upper circulation in this example is connected to the second (bottom) row of the upper cook screens. In this example, more than about 35% of the total dissolved calcium may be removed from the digester system, significantly reducing the tendency of calcium scaling on digester screens and cooking heaters.

The present method is operable with both hardwood pulp and softwood pulp.

Figure 6:
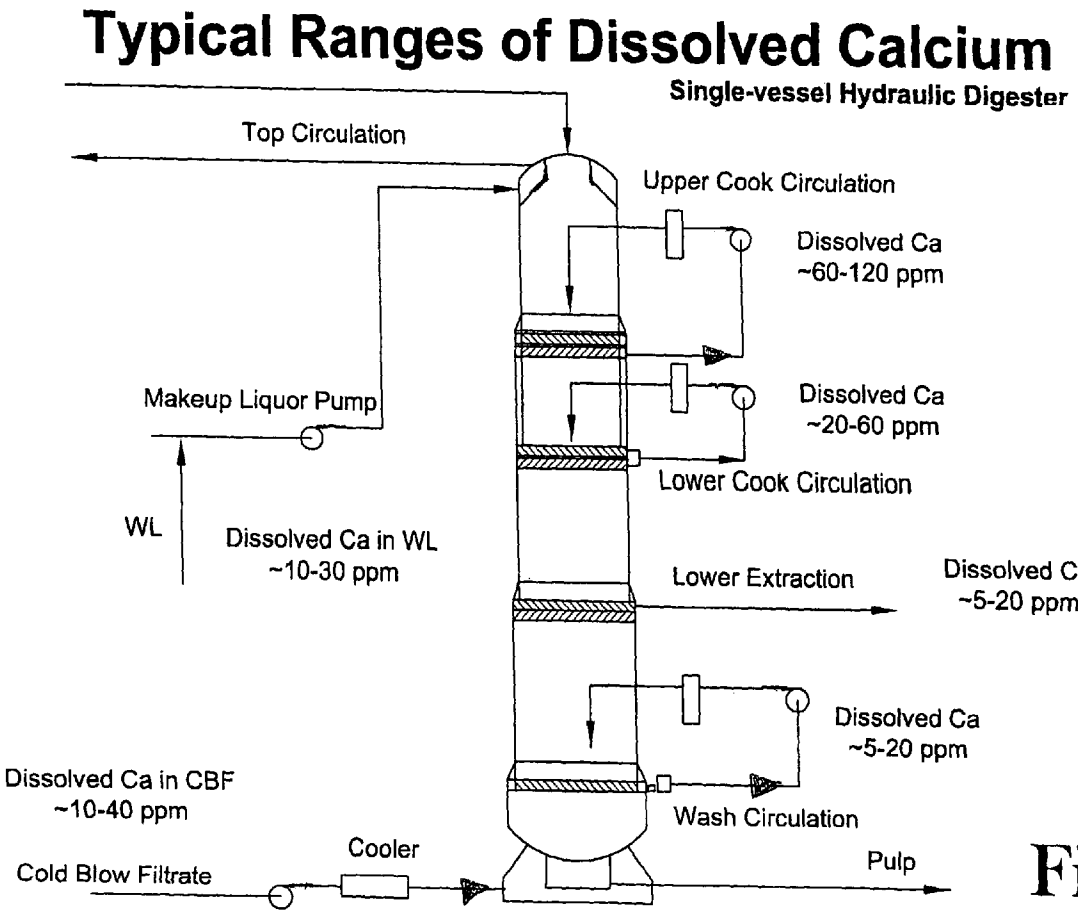
FIG. 6 is a schematic representation as in FIG. 1 and depicting typical ranges of calcium concentration associated with the single-vessel digester.

Table I presents typical ranges of calcium concentrations in the cooking liquor in various locations in a digester as shown in FIG. 6.

TABLE I

| Process Point | Calcium (ppm) |
|---|---|
| White liquor (WL) | 10-30 |
| Impregnation vessel/zone, (before the first heating circulation) | 40-120 |
| Between heating and full cooking temperature | 20-60 |
| More than 60 minutes after reaching full cooking temperature | 5-20 |
| Cold blow (washing) filtrate | 10-40 |

Employing these calcium concentration ranges, one skilled in the art may readily determine the optimal locations at which cooking liquor may be extracted from the digester and where makeup liquor of lesser calcium concentration should be introduced to the digester.

Inasmuch as the dissolved calcium concentration in cooking liquor may vary as a function of the initial carbonate ion concentration, a significant amount of the cooking liquor should be withdrawn around the process point where the dissolved calcium concentration peaks. At what cooking temperature (corresponding to a certain digester location) the dissolved calcium concentration peaks depends on the carbonate concentration in the liquor. The higher the initial carbonate concentration in the liquor, the earlier the dissolved calcium concentration peaks within the digester.

Logistically, the preferred location in the digester for replacing cooking liquor high in dissolved calcium with a liquor low in dissolved calcium is the first set of cooking circulation screens in a single-vessel continuous digester. Similarly the most suitable location to replace the extracted calcium-rich liquor with a liquor low in dissolved calcium is the chip transfer line (bottom circulation as known in the art) leading into the digester (the second vessel in FIG. 2) or the first set of screens immediately after the transfer line in a two-vessel continuous digester system.

Alternatively, (1) one may extract a sufficient amount of one of the process streams from a process point in a continuous digester that is located at least several minutes after full cooking temperature is reached, adding this process stream to an early stage of the cook, e.g. the feeding system or the bottom circulation, and extract an optimal amount of cooking liquor downstream of the addition point and upstream of the process point where full cooking temperature is reached Further, same as Item (1) above, except that the temperature of the added process stream may be controlled by use of a heat exchanger, such that a desire pulping temperature profile is maintained.

Still further, same as Item (1) above, except that more than one process stream may be extracted from different process points after full cooking temperature is reached and that the temperature of one or more of the streams may be controlled by the use of one or more heat exchangers.

Figure 3:
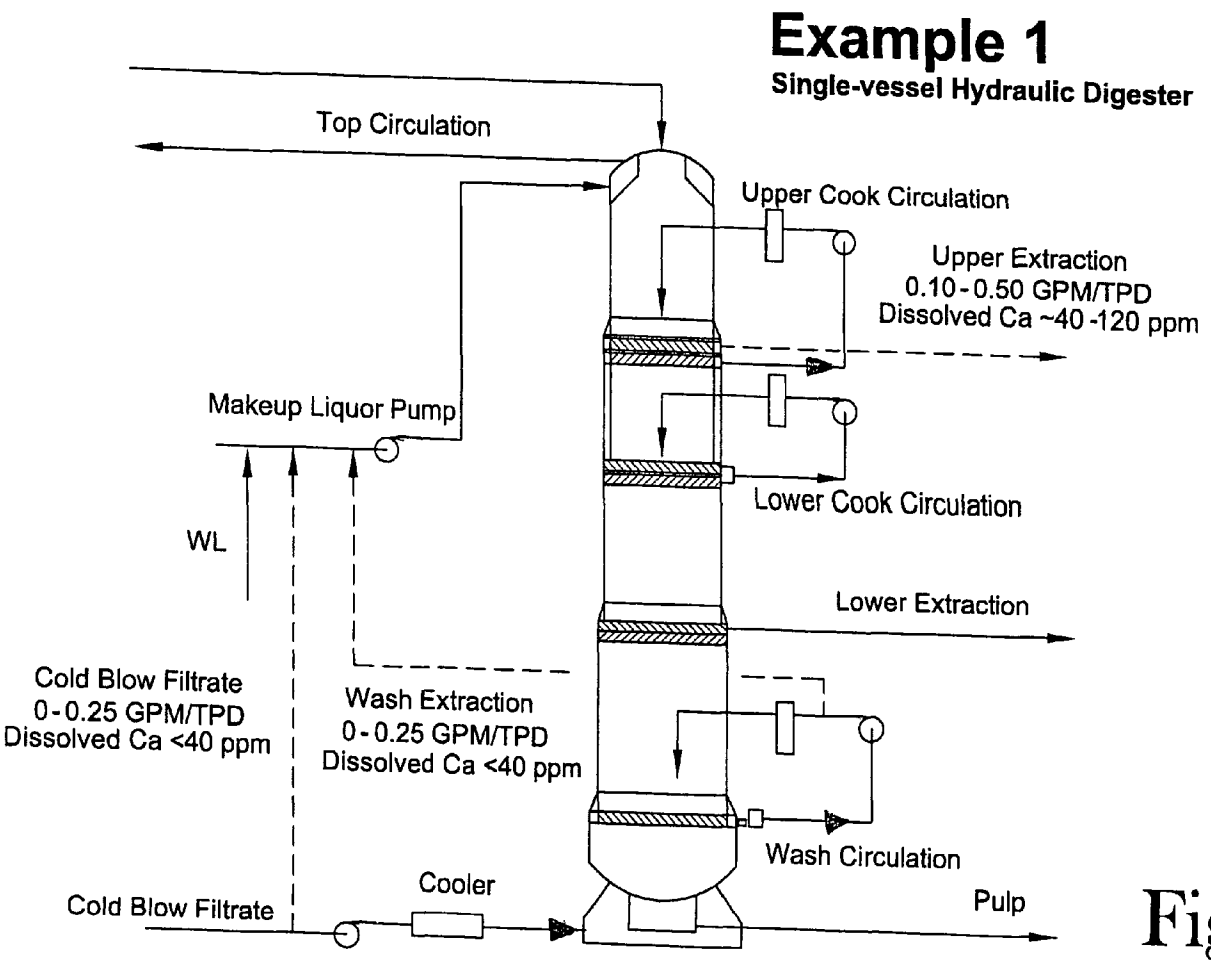
FIG. 3 is a schematic representation as in FIG. 1 and including certain aspects of Example I of the specification.
Figure 4:
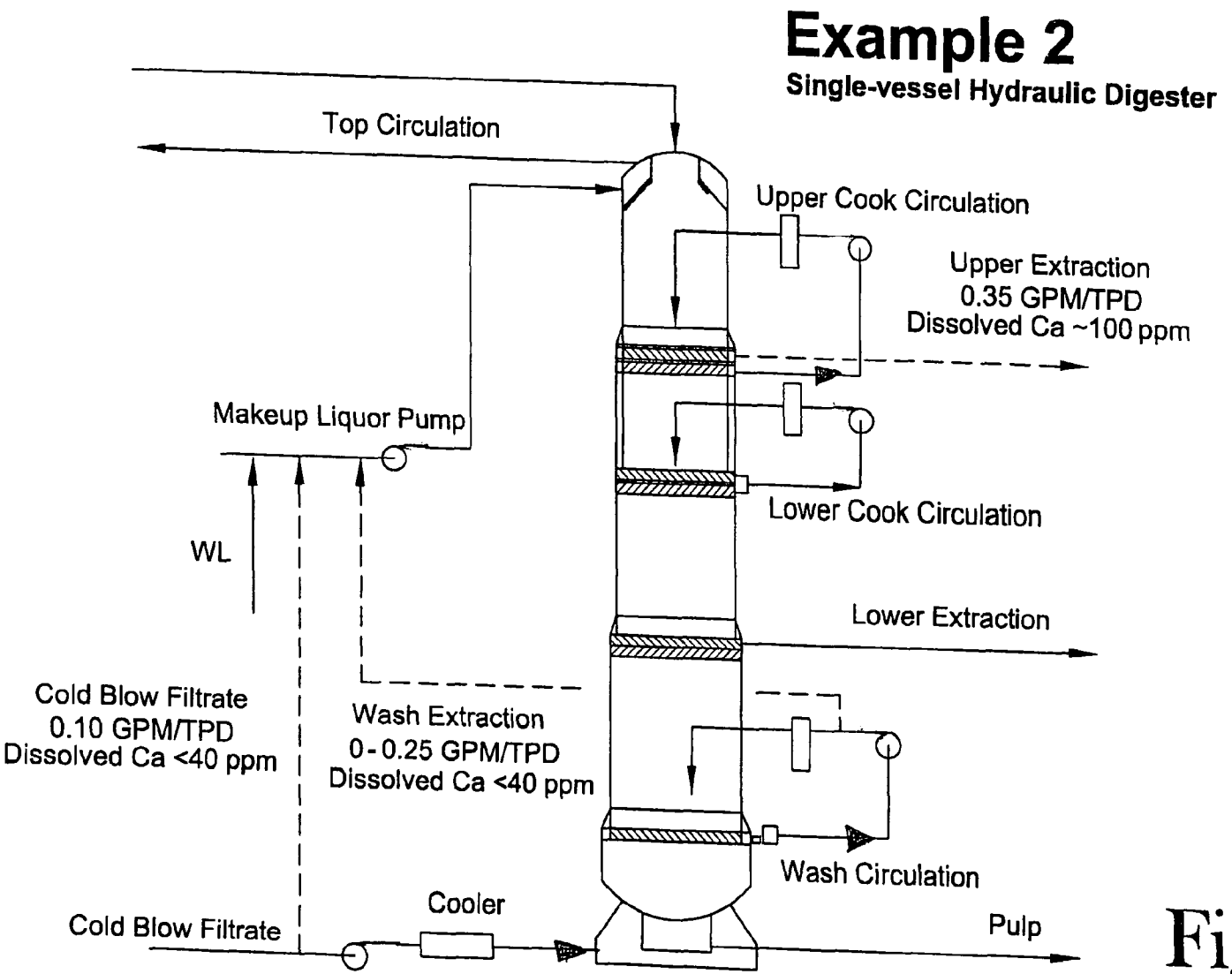
FIG. 4 is a schematic representation as in FIG. 1 and including certain aspects of Example II of the specification.
Figure 5:
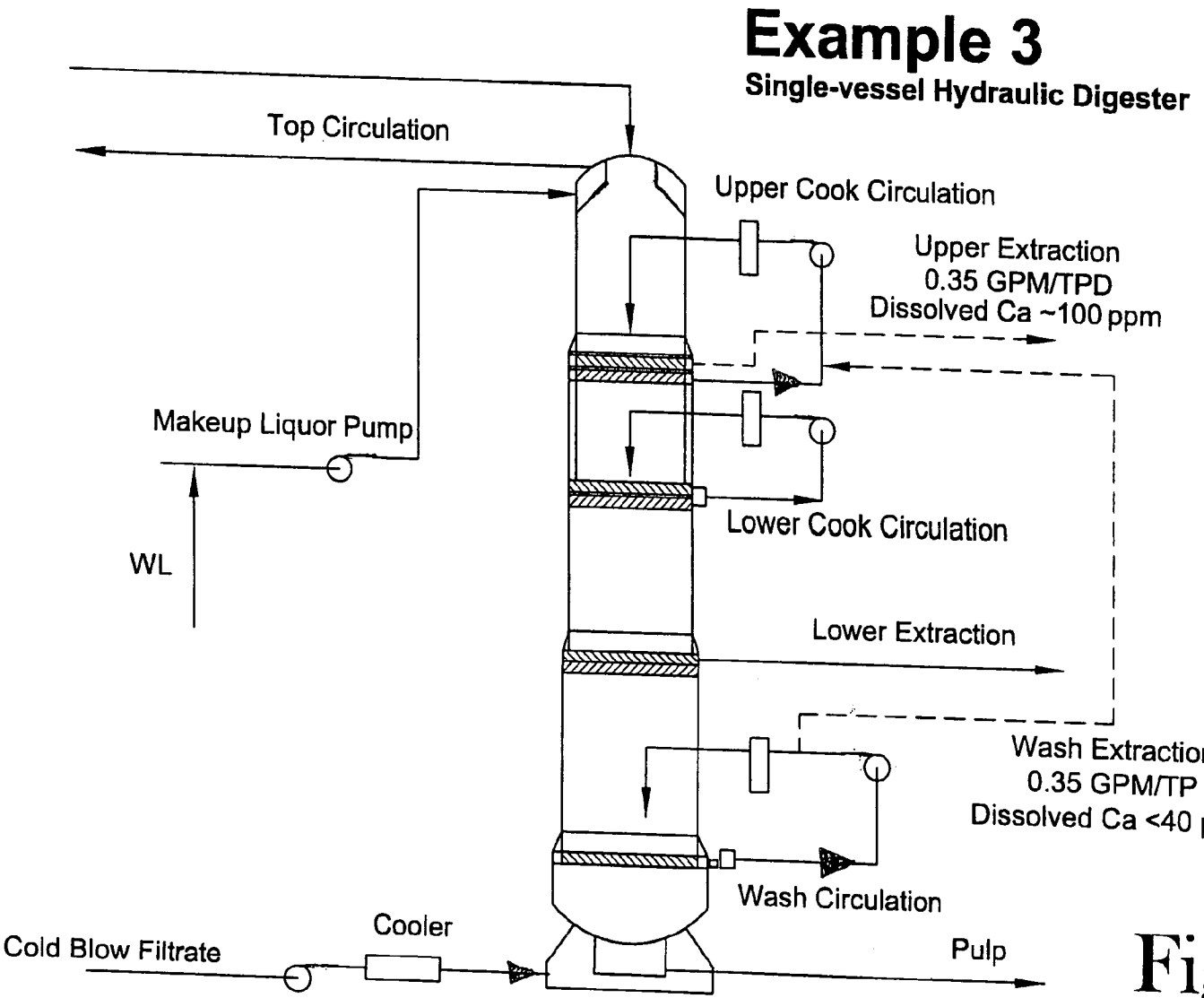
FIG. 5 is a schematic representation as in FIG. 1 and including certain aspects of Example III of the specification.

Another significant benefit, namely an increased maximum sustainable pulp production, is achieved from another preferred embodiment of the present invention. According to this embodiment, the upper extraction flow rate described in Examples I-III above (also depicted in FIGS. 3-5) is controlled to be significantly lower than the flow rate of the cooking liquor or a mixture of cold blow filtrate and a cooking liquor low in dissolved calcium, such that the amount of liquor (expressed as flow rate) around the chips in a digester, and thus the downward force acting on the chips, is significantly increased. This increased downward force acting on the chips results in a more stable chip column movement, and an increased maximum sustainable digester pulp production if column movement has been the limiting factor in obtaining a higher maximum digester pulp production.

Other variations in the method of the present invention will be recognized by one skilled in the art and the invention is to be limited only as set forth in the claims appended hereto.

What is claimed is:

1. An apparatus for continuous digestion of wood chip comprising:

an upright generally cylindrical vessel having a top end and a bottom end, the top end of the cylindrical vessel being adapted to receive wood chips mixed with a cooking liquor to be treated therein wherein the cylindrical vessel comprises an upper extraction point and a lower extraction point between the top and bottom ends of the vessel wherein the upper extraction point and the lower extraction point withdraw cooking liquor from the vessel without recirculating the cooking liquor back to the vessel;

a first conduit integrally attached at a first location being defined by an upper cook zone positioned between the top and bottom ends of the vessel for selectively extracting a first quantity of cooking liquor from the vessel and wherein the first location positioned upstream of a second location being defined by an area between the upper extraction point and the lower extraction point within the vessel where the cooking liquor being at substantially full cooking temperature;

a second conduit integrally attached at a third location positioned downstream from the first and second locations of the vessel and at a fourth screen section on the bottom end of the vessel, the second conduit being in fluid communication with a fourth location positioned at a suction side of a makeup liquor pump for selectively extracting a second quantity of cooking liquor from the vessel at the third location and transporting at least a portion of the extracted second quantity of cooking liquor to the fourth location.

2. The apparatus of claim 1 wherein the fourth location is positioned outside of the vessel.

3. The apparatus of claim 1 wherein the fourth location is positioned near the first location.

4. The apparatus of claim 1 further comprising a third conduit integrally attached to a fifth location positioned outside of the vessel, the third conduit being in fluid communication with the fourth location positioned at, about below or upstream from the first location for selectively extracting a second quantity of cooking liquor from the vessel.

5. The apparatus of claim 4 wherein the third conduit integrally attached to the fifth location is positioned near the bottom end of the vessel.

6. The apparatus of claim 1 wherein the cylindrical vessel comprises at least one extraction point between the top and bottom ends of the vessel.

7. The apparatus of claim 1 further comprising at least one cook circulation sub-system disposed between the top end and the bottom end of the vessel.

8. The apparatus of claim 1 further comprising at least one wash circulation sub-system disposed between the top end and the bottom end of the vessel.

9. The apparatus of claim 1 further comprising an impregnation vessel attached to the cylindrical vessel through a plurality of process pipes.

10. The apparatus of claim 1 wherein the cylindrical vessel is a continuous digester.

11. An apparatus for continuous digestion of wood chip comprising:

a vessel having a top end and a bottom end, the top end of the vessel being adapted to receive wood chips mixed with a cooking liquor to be treated therein wherein the cylindrical vessel comprises an upper extraction point and a lower extraction point between the top and bottom ends of the vessel wherein the upper extraction point and the lower extraction point withdraw cooking liquor from the vessel without recirculating the cooking liquor back to the vessel;

a first conduit integrally attached at a first location positioned between the top and bottom ends of the digester for selectively extracting a first quantity of cooking liquor from the vessel and wherein the first location positioned upstream of a second location within the vessel where the cooking liquor being at substantially full cooking temperature;

a second conduit integrally attached at a third location positioned downstream from the first and second locations of the vessel and at a fourth screen section on the bottom end of the vessel, the second conduit being in fluid communication with a fourth location positioned at a suction side of a makeup liquor pump for selectively extracting a second quantity of cooking liquor from the vessel at the third location and transporting at least a portion of the extracted second quantity of cooking liquor to the fourth location; and a third conduit being defined by a pipe connecting the vessel to a cold blow filtrate, the third conduit integrally attached to a fifth location, defined by cold blow filtrate, positioned outside of the vessel, the third conduit being in fluid communication with the fourth location positioned at, about below or upstream from the first location for selectively extracting a second quantity of cooking liquor from the vessel.

12. The apparatus of claim 11 wherein the first quantity of cooking liquor is extracted from the vessel at a first location upstream of a location within the vessel where the cooking liquor has achieved substantially full cooking temperature.

13. The apparatus of claim 11 wherein the second quantity of cooking liquor is reintroduced to the vessel at the third location positioned at, about below or upstream of the first location of extraction of the second quantity of cooking liquor.

14. The apparatus of claim 11 wherein the second quantity of cooking liquor is reintroduced to the vessel at the third location upstream of said second location of extraction of said second quantity of cooking liquor.

15. The apparatus of claim 11 wherein said second quantity of cooking liquor is mixed with other process liquors at a location external of the vessel to form a mixture comprising said second quantity of cooking liquor and said mixture is reintroduced to the vessel.

16. The apparatus of claim 11 further comprising a circulation pump being attached thereto to transfer the reintroduced at least the portion of the second quantity of cooking liquor back to the vessel.

17. An apparatus for continuous digestion of wood chip comprising:

an upright generally first cylindrical vessel having a top end and a bottom end, the top end of the first cylindrical vessel being adapted to receive wood chips mixed with a cooking liquor to be treated therein;

an upright generally second cylindrical vessel configured to be in fluid communication with the first cylindrical vessel, the second vessel having a top end and a bottom end, the top end of the second cylindrical vessel being adapted to receive the treated wood chips from the first vessel;

a first conduit integrally attached at a first location, defined by a trim circulation screens, positioned between the top and bottom ends of the second cylindrical vessel for selectively extracting a first quantity of cooking liquor from the second cylindrical vessel and wherein the first location positioned upstream of a second location within the second cylindrical vessel where the cooking liquor being at substantially full cooking temperature;

a conduit integrally attached to a bottom circulation line for circulating liquor from the trim circulation screens; and a second conduit integrally attached at a third location positioned downstream from the first and second locations of the second cylindrical vessel and at a fourth screen section on the bottom end of the vessel, the second conduit being in fluid communication with a fourth location positioned at the bottom circulation line for selectively extracting a second quantity of cooking liquor from the second cylindrical vessel at the third location and transporting at least a portion of the extracted second quantity of cooking liquor to the fourth location.

18. The apparatus of claim 17 wherein the first vessel is an impregnation vessel.

* * * * *